US006036546A

United States Patent [19]

Dingenotto

[11] Patent Number: 6,036,546

[45] Date of Patent: Mar. 14, 2000

[54] ADAPTER FOR CONNECTING TOGETHER TWO SIGNAL TRANSMISSION LINES EACH TERMINATING IN MULTIPLE CONNECTORS

[75] Inventor: Meinolf Dingenotto, Schloss-Holte-Stukenbrock, Germany

[73] Assignee: Filtec Filtertechnologie für die Elektronikindustrie GmbH, Lippstadt, Germany

[21] Appl. No.: 09/212,425

[22] Filed: Dec. 16, 1998

[30] Foreign Application Priority Data

Dec. 16, 1997 [DE] Germany ..... 197 55 968

[51] Int. Cl.[7] ..... H01R 13/66

[52] U.S. Cl. ..... 439/620; 439/905

[58] Field of Search ..... 439/620; 11/905

[56] References Cited

U.S. PATENT DOCUMENTS 4,215,326 7/1980 Hollyday .
5,597,328 1/1997 Mouissie .
5,704,810 1/1998 Shimasaki ..... 439/620
5,769,667 6/1998 Belopolsky ..... 439/620
5,838,216 11/1998 White et al. ..... 439/620

FOREIGN PATENT DOCUMENTS 0 003 162 7/1979 European Pat. Off. .
0 780 929 6/1997 European Pat. Off. .

*Primary Examiner*—Michael L. Gellner
*Assistant Examiner*—Antoine Ngandjui
*Attorney, Agent, or Firm*—Burns, Doane, Swecker & Mathis, L.L.P.

[57] ABSTRACT

An adapter for connecting two multi-polar signal transmission lines that has a shielded housing. The housing contains a planar filter which carries capacitors corresponding to the number of signal transmission lines together with separate signal-electrodes and common ground-electrodes, whereby the ground-electrodes are placed o the side of the planar filter. Each signal-electrode has a contact surface to make connection to the corresponding transmission lines. The housing has two identical shell-shaped middle pieces and two collars. One end of each middle piece is soldered to a respective collar, and the two middle pieces are soldered together at a coupling location that forms a support to which the filter is soldered.

7 Claims, 2 Drawing Sheets

Figure 1:
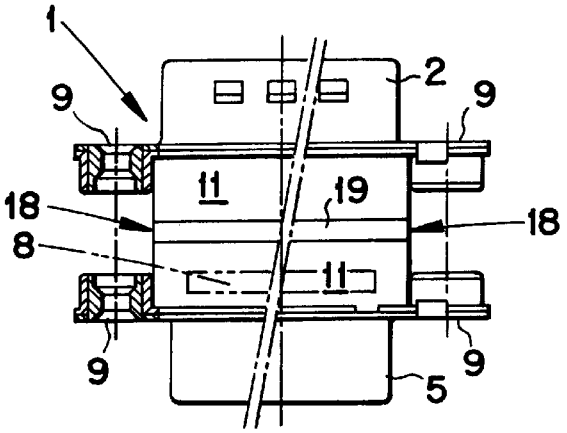

ADAPTER FOR CONNECTING TOGETHER TWO SIGNAL TRANSMISSION LINES EACH TERMINATING IN MULTIPLE CONNECTORS

BACKGROUND OF THE INVENTION

The invention relates to an adapter for connecting two signal transmission lines, each line terminating in multiple connectors, i.e., pins or jacks (sockets) (see for example, U.S. Pat. No. 5,597,328). The adapter has two sets of connectors, each set being connectable with one of the transmission lines. The connectors may comprise pins or jacks. Thus, the adapter can comprise a set of pins and a set of jacks, or two sets of pins or two sets of jacks. The adapter also includes a planar filter disposed in an at least-partially shielded housing whereby the signal transmission lines transmit digitized electronic signals. The planar filter has a number of capacitors with signal electrodes corresponding to the number of signal transmission lines and a common ground electrode, both separated by a dielectric insulator, whereby the ground electrode, at least in the form of a strip, is placed on one side of the planar filter and whereby each of the signal electrodes has a contact surface for connection to the corresponding signal transmission line.

Such adapters are used in the connection of signal transmission lines for digitized electronic signals, whereby the adapters have connectors of the above-described types that makes possible a continuous connection of two signal transmission lines with opposite (inverted) plug-in connectors. The planar filters, which are well known, make interference-free transmission possible through the individual signal transmission lines filtered through a C-link. Such interference suppressors guarantee a high shielding effect of the adapter so that interference from the outside is suppressed and does not negate filtering. All-metal housings made from die-cast zinc are well known for this purpose, which need a considerable housing thickness to reach a sufficient screening effect because of the relative low conductivity of zinc alloy. Thereby all-metal housings have a higher weight and because of this relatively high weight, considerable forces must be taken into consideration should such all-metal housing be used in rockets, for example.

Therefore it is the task of the invention to develop a similar-type adapter whereby the adapter is of lighter weight and which may be manufactured more easily and economically and is operationally safe as well.

SUMMARY OF THE INVENTION

This task is solved according to the invention by the use of two shell-shaped middle pieces. One end of each shell-shaped middle piece has an 10 outwardly bent flange that connects with the corresponding collar piece. Opposite ends of the shell-shaped middle pieces which are facing one another have inwardly bent flanges rounded in such a manner that a soldering gap is created therebetween. The inwardly bent flanges are soldered together side-by-side, whereby solder fills the soldering gap.

The inwardly bent flanges form a base for the planar filter. The grounding strip of this planar filter is connected with these inwardly bent flanges by additional soldering and is thereby attached to the housing in a manner maintaining electrical conductivity therewith. Thereby continuous shielding is accomplished by the use of highly conductive material, and sufficient shielding may be obtained even with a relative thin housing formed of light material. These inwardly bent flanges form a good base for the planar filter.

That filter may be installed in a simple manner and may be safely connected mechanically and with electrical conductivity with the all-metal housing.

The inwardly bent flanges of the shell-shaped middle pieces serve as a base for the planar filter; plastic inserts may rest against these flanges where plug pins are mounted and these inserts hold the free-standing pins in place at their base. Thereby the edges are advantageously formed with notches and these notches may be punched out in a key-shaped pattern or in a triangular shape of a pointed trowel. This design makes possible that the shell-shaped middle pieces are drawn down to the same level together with the base surface. The stress line of the mechanical stress caused by the draw-down process is interrupted in the area of the inwardly bent flanges, whereby a coplanar position is maintained.

The encompassing soldering has to transfer applied forces and the force limit is determined by the choice of metal and solder and essentially by the make-up of the soldering location itself. The gap is filled with solder so that the surface of the (poured) solder facing outward forms a meniscus. The shape is chosen in such manner that the length of the meniscus is at least 20% greater than the minimum width of the gap.

During final assembly of the adapter, the planar filter is placed into the housing after soldering of the housing and is thereby placed against the inwardly turned edges and is subsequently soldered there with a second soldering procedure, It is important to have the inwardly bent flanges all at the same plane (coplanar) to obtain good and interference-free soldering.

BRIEF DESCRIPTION OF THE INVENTION

The characteristics of the invention are described in more detail in the accompanying drawing wherein:

FIG. 1: Adapter according to the invention in side view, broad side (broken)

Figure 2:
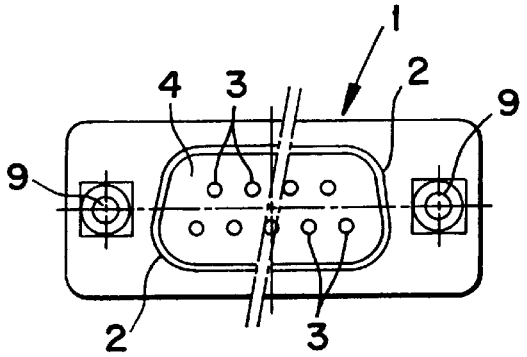

FIG. 2: Adapter of FIG. 1 in top view

Figure 3:
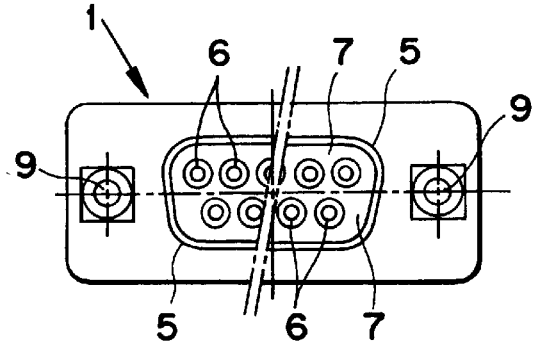

FIG. 3: Adapter of FIG. 1 in bottom view

Figure 4:
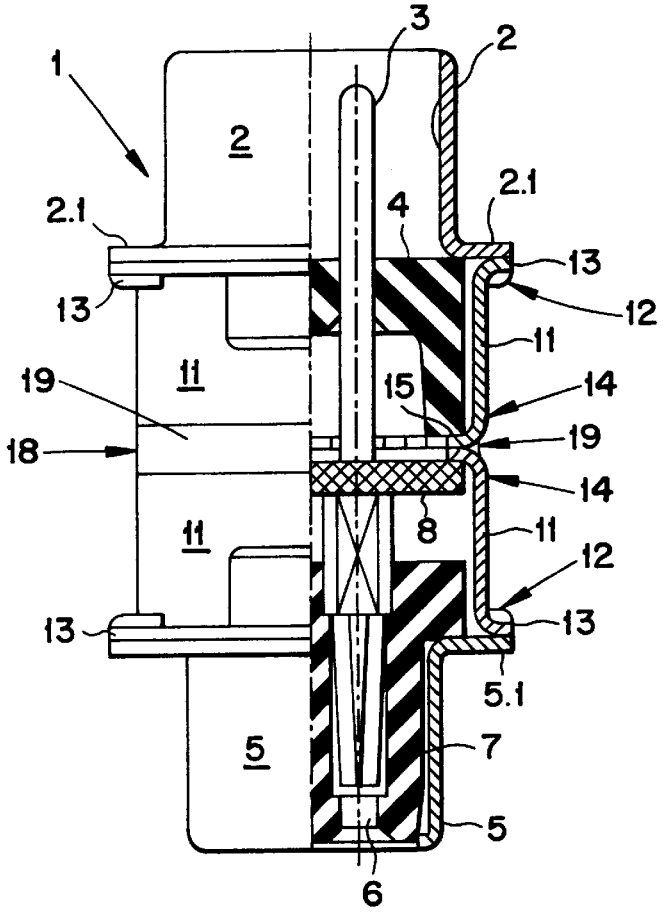

FIG. 4: Adapter side view, partially in longitudinal section (cut in half)

Figure 4A:
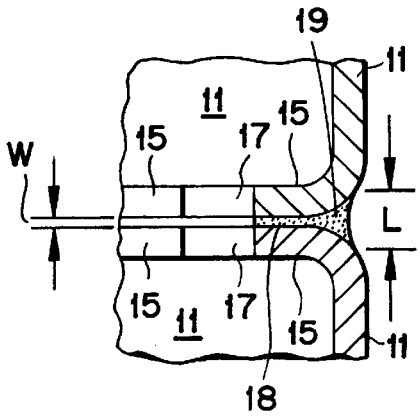

FIG. 4*a*: shows details of soldering gap

Figure 4B:
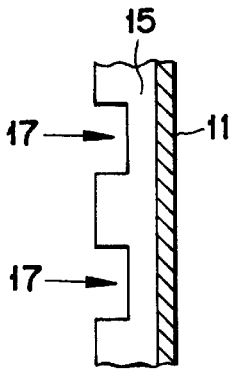

FIG. 4*b*: shows details of base edge

Figure 4C:
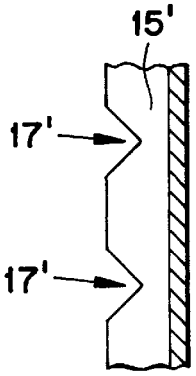

FIG. 4*c*: shows details of an alternate embodiment of base edge.

BRIEF DESCRIPTION OF PREFERRED EMBODIMENTS OF THE INVENTION

The drawings show an adapter having a housing 1, which carries, on one side, plug pins 3 and on the opposite side, pin jacks 6. The pins 3 and pin jacks 6 can received cables equipped with corresponding male/female connectors. Plug pins 3 are held in place in an insulation element 4 wherein the pins are mounted in a standard pattern. A collar 2 of the housing is situated to encompass outer ends of the plug pins and ensures that a correcting plug (not shown) is lined-up correctly. The pin jacks 6 are held in place in an insulation element 7 and mounted in a standard pattern. The pin jack arrangement is also enclosed by a collar 5.

The collar 2 on the pin side and the collar 5 on the jack side have flanges 2.1 and 5.1, respectively, that are bent to the outside so that two shell-shaped middle pieces 11 may be soldered in place (whereby it makes no difference whether the adapter makes connection from pin-to-pin, pin-to-jack or from jack-to-jack) and to which the connections of individual plug-in connectors are established. A planar filter 8 of known construction is grounded to the connecting edges, which edges have electric conductivity with the housing 1. The planar filter has a number of capacitors with signal electrodes corresponding to the number of signal transmission lines and a common ground electrode, both separated by a dielectric insulator, whereby the ground electrode, at least in the form of a strip is placed on one side of the planar filter and whereby each of the signal electrodes has a contract surface for connection to the corresponding signal transmission line. The planar filters, which are well known, make interference-free transmission possible through the individual signal transmission lines filtered through a C-link. Such interference suppressors guarantee a high shielding effect of the adapter so that interference from the outside is suppressed and does not negate filtering.

Both shell-shaped middle pieces 11 are of identical shape whereby opposite axial ends 12 of the middle pieces have a radially outwardly bent encircling edge 13 that may be soldered to the radially outwardly bent edge 2.1 or 5.1 of the corresponding collars 2 or 5 of the adapter housing 1. The axial inner end 14 of each middle piece 11 has a radially inwardly bent edge 15 and these edges 15 are soldered together to close the housing 1. The edges 15 form a soldering gap 18 therebetween which is filled with solder. The radially outer portion of the soldering gap 18 is rounded in such manner that the soldering gap is progressively enlarged toward the outside. The solder has a radially outwardly facing surface 19 disposed in the enlarged opening. That surface has the shape of a meniscus that is rounded off (concave). This meniscus-shaped soldering is greater in length L than a minimum width W of the gap 18. The rounded part of the meniscus-shaped soldering is formed in such a manner that its length L is at least 20% greater than the minimum width W. Also, the solder enters the region between the bent-in edges 15.

It is essential for a good disposition of the planar filter 8 for the filter to be soldered to the inwardly bent edge 15 of one of the middle pieces 11 and be electrically connected thereto. The middle pieces 11, as well as collars 2 and 5, are manufactured by a deep-drawing process in order to produce these pieces economically. The mechanical stress caused by bending the edges 15 could cause deforming of those edges. Therefore the inwardly bent edges 15 have recesses 17 that are punched out in circumferentially spaced relationship (see FIG. 4). The illustrated right-angled rectangular recesses 17 appear as a key pattern at the edge. Alternatively, the recesses 17 could be of triangular shape as shown in the alternative bent edge 15' of FIG. 4*c*.

Although the adapter has been disclosed as having connectors in the form of a set of pins 3 and a set of jacks 6, it could instead have two sets of pins or two sets of jacks.

Although the present invention has been described in connection with preferred embodiment thereof, it will be appreciated by those skilled in the art that additions, deletions, modifications, and substitutions not specifically described may be made without departing from the spirit and scope of the invention as defined in the appended claims.

What is claimed is:

1. An adapter for interconnecting two signal transmission lines, the adapter comprising:

a housing including:

first and second collars, each collar carrying multiple connectors that are at least partially shielded, and first and second middle pieces disposed in a space formed between the first and second collars, the first and second middle pieces being of identical configuration, each of the first and second middle pieces including a radially outwardly bent flange disposed at one end thereof, and a radially inwardly bent flange disposed at an opposite end thereof, the radially outwardly bent flange of the first middle piece being soldered to the first collar, the radially outwardly bent flange of the second middle piece being soldered to the second collar, and the radially inwardly bent flanges of the first and second middle pieces being soldered to one another; and a planar filter including a plurality of capacitors, a plurality of signal electrodes adapted for connection with respective transmission lines, and a common ground electrode, the filter having an outer periphery bearing against one of the radially inwardly bent flanges.

2. The adapter according to claim 1 wherein the outer periphery of the filter is soldered to one of the radially inwardly bent flanges and is electrically connected thereto.

3. The adapter according to claim 1 wherein the two radially inwardly bent flanges from a soldering gap therebetween that is substantially filled with solder.

4. The adapter according to claim 3 wherein each of the radially inwardly bent flanges includes a radially outwardly facing portion that is rounded, whereby the solder gap is gradually enlarged in a region disposed between the rounded portions, a portion of the solder disposed in that region including a radially outwardly facing meniscus surface of concave shape, a length of the meniscus surface being at least 20% greater than a minimum width of the solder gap.

5. The adapter according to claim 1 wherein each of the inwardly bent flanges has circumferentially spaced notches formed therein.

6. The adapter according to claim 5 wherein each of the notches is of right-angle rectangular shape.

7. The adapter according to claim 5 wherein the notches are of triangular shape.

* * * * *